US006414667B1

(12) United States Patent
Bonnett et al.

(10) Patent No.: US 6,414,667 B1
(45) **Date of Patent: *Jul. 2, 2002**

(54) LIQUID CRYSTAL DEVICE AND METHOD ADDRESSING LIQUID CRYSTAL DEVICE

(75) Inventors: Paul Bonnett; Michael John Towler, both of Oxford (GB)

(73) Assignees: Sharp Kabushiki Kaisha, Osaka (JP); The Secretary of State for Defence in Her Britannic Majesty's Government of the United Kingdom of Great Britain and Northern Ireland, Farnborough (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/232,325

(22) Filed: Jan. 18, 1999

(30) Foreign Application Priority Data

Jan. 21, 1998 (GB) ..... 9801299

(51) Int. Cl.[7] ..... G09G 3/36
(52) U.S. Cl. ..... 345/97; 345/94
(58) Field of Search ..... 345/97, 94, 96, 345/87, 208, 210, 95, 103

(56) References Cited

U.S. PATENT DOCUMENTS 5,151,805 A * 9/1992 Takeda et al. ..... 345/94
5,706,023 A * 1/1998 Nagata et al. ..... 345/94

FOREIGN PATENT DOCUMENTS

| | | |
|---|---|---|
| EP | 0149899 | 7/1985 |
| EP | 0214856 | 3/1987 |
| EP | 0306203 | 3/1989 |
| GB | 2175725 | 12/1986 |
| GB | 2208559 | 4/1989 |

OTHER PUBLICATIONS

"Preliminary Communications—A new set of high speed matrix addressing schemes for ferroelectric liquid crystal displays", J.R. Hughes, et al., *Liquid Crystals*, 1993, vol. 13, No. 4, pp. 597–601.

"Addressing Cycles for Fast Settling Grey Shades in Ferroelectric Liquid Crystal Matrices", P. Maltese, et al., *Ferroelectrics*, 1988, vol. 85, pp. 265–274.

PCT International Publication No. WO 95/28697, Published Oct. 26, 1995.

"The 'Joers/Alvey' Ferroelectric Multiplexing Scheme," P.W.H. Surguy, et al., *Ferroelectrics*, 1991, vol. 122, pp. 63–79.

"Fast, High–Contrast Ferroelectric Liquid Crystal Displays and the Role of Dielectric Biaxiality", J.C. Jones, et al., *Displays*, 1993, vol. 14, No. 2, pp. 86–93.

* cited by examiner

*Primary Examiner*—Dennis-Doon Chow
(74) *Attorney, Agent, or Firm*—Renner, Otto, Boisselle & Sklar

(57) ABSTRACT

A liquid crystal device is addressed in a multiplexed manner by a scanning signal applied in turn to a first set of electrodes together with data signals applied to a second set of electrodes. The first and second sets of electrodes define a plurality of pixels. The pattern to be exhibited by the device determines the waveform applied to the second set of electrodes which can vary between extremes of frequency. This has adverse effects on device performance, particularly with regard to contrast. To ameliorate the problem a low frequency signal is added to the scanning signal which incorporates a known strobe pulse. This low frequency signal reduces the effect on the pixels of the extremes of data signal frequency.

24 Claims, 6 Drawing Sheets

LIQUID CRYSTAL DEVICE AND METHOD ADDRESSING LIQUID CRYSTAL DEVICE

FIELD OF THE INVENTION

The present invention relates to a liquid crystal device having a novel addressing technique. The invention also relates to a method of addressing a liquid crystal device and to an arrangement for addressing a liquid crystal device.

BACKGROUND OF THE INVENTION

In a liquid crystal device array there are typically a first set of electrodes (or row electrodes) arranged on a first substrate of the device and a second set of electrodes (or column electrodes) arranged on an opposite substrate of the device. These sets of electrodes generally comprise electrodes arranged parallel to one another but at right angles to the electrodes in the other set. The intersection between a row electrode and a column electrode defines a picture element or pixel of the array. Each pixel of the array can be uniquely addressed by applying a scanning signal to each of the row electrodes in turn, while a data signal is applied to each of the column electrodes. The data and scanning signals must be carefully selected so that only those pixels in the row to which the scanning signal is applied will adopt the state as a consequence of the data signal. Once a scanning signal has been applied to all of the row electrodes, the process can start again with potentially different data signals applied.

The scanning signal typically comprises a blanking pulse and a strobe pulse. The blanking pulse operates independently of the data signal to place all of the pixels in a particular row in a known state (typically the black state). Once the blanking pulse has altered the state of any pixels in the row which have previously occupied the other state, a strobe pulse is applied to the row electrode simultaneously with a data signal. The data signal may be selected from two or more possible data signals to place the pixel in the desired state.

The data signals are applied to the second plurality (column) electrodes continuously and thus cause both device heating and a reduction in contrast of the display.

SUMMARY OF THE INVENTION

It is an object of the present invention to provide an addressing technique for liquid crystal devices that ameliorates these disadvantages.

According to a first aspect of the present invention there is provided a method of addressing a liquid crystal device having a first plurality of electrodes and a second plurality of electrodes defining a plurality of pixels at the intersections between at least one of the first plurality of electrodes and at least one of the second plurality of electrodes, the method comprising applying a scanning signal including at least one strobe portion to each of the first plurality of electrodes over a frame, applying data signals to each of the second plurality of electrodes to cooperate with the at least one strobe portion of the scanning signal, wherein the scanning signal further comprises an alternating signal having a frequency greater than the frame rate and less than or equal to the lowest possible frequency applied to the device by the data signals.

According to a second aspect of the present invention there is provided a liquid crystal device having a first plurality of electrodes and a second plurality of electrodes defining a plurality of pixels at the intersections between at least one of the first plurality of electrodes and at least one of the second plurality of electrodes, further comprising means for applying one frame of a scanning signal including at least one strobe portion to each one of the first plurality of electrodes, means for applying data signals to each of the second plurality of electrodes to cooperate with the at least one strobe portion of the scanning signal, wherein the scanning signal further comprises an alternating signal having a frequency greater than the frame rate and less than or equal to the lowest possible frequency applied to the device by the data signals.

According to a third aspect of the present invention there is provided an addressing arrangement for a liquid crystal device having a first plurality of electrodes and a second plurality of electrodes defining a plurality of pixels at the intersections between at least one of the first plurality of electrodes and at least one of the second plurality of electrodes, the arrangement comprising means for applying one frame of a scanning signal including at least one strobe portion to each one of the first plurality of electrodes, means for applying data signals to each of the second plurality of electrodes to cooperate with the at least one strobe portion of the scanning signal, wherein the scanning signal further comprises an alternating signal having a frequency greater than the frame rate and less than or equal to the lowest possible frequency applied to the device by the data signals.

The invention operates by applying a low frequency signal to the row electrodes of the array. This results in a smaller difference in contrast between extreme addressing scenarios and reduced power consumption. The invention may be applied to an addressing scheme using bipolar strobe portions or to an addressing scheme using blanking portions.

Since most of the power consumption comes from the data signal, a reduction in the data signal significantly reduces the power consumption. However, the voltage level of the data signal provides addressing discrimination and the AC stabilization effect, and therefore the invention resides in the addition of an AC signal to the scanning signal to recover AC stabilization and also make the effect more data pattern independent. In order to achieve such data pattern independence (and also so as not to insignificantly increase power consumption) the AC signal applied should be of relatively low frequency and related to the data frequency.

Further preferred features of the invention are set out in the dependent claims and will be apparent to the skilled person on reading the following description.

The present invention will now be described by way of example with reference to the accompanying drawings.

DESCRIPTION OF THE EMBODIMENTS

Figure 1:
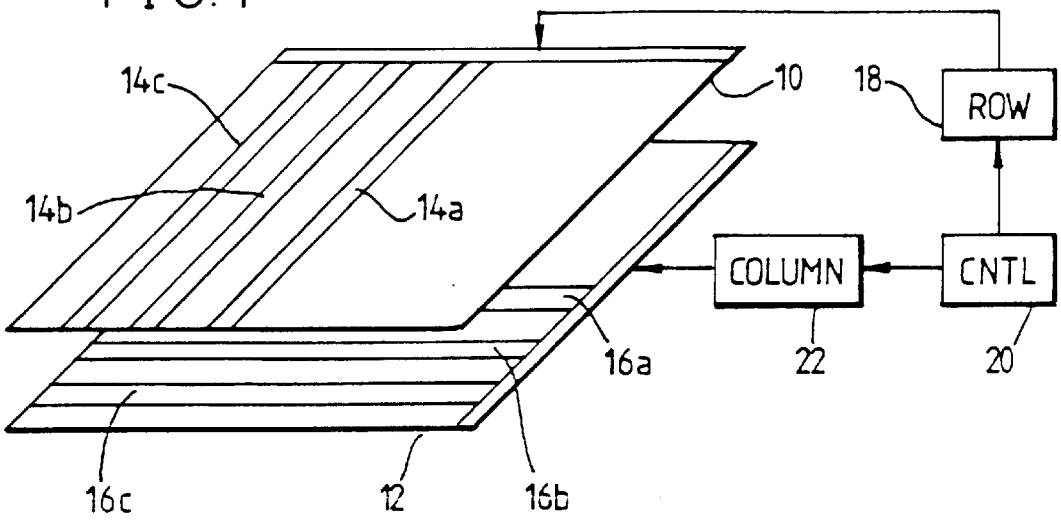
FIG. 1 shows a crossed electrode arrangement on a liquid crystal array device together with row and column drivers.

FIG. 1 shows a perspective view of a liquid crystal array device to which the addressing technique of the present invention may be applied. A first substrate 10 is arranged opposite a second substrate 12 and liquid crystal material (not shown) would be arranged between the substrates. The substrate 10 carries a plurality of electrodes 14 arranged parallel to one another. For simplicity, FIG. 1 shows only three of these electrodes 14*a*, 14*b* and 14*c*. The substrate 12 also carries a plurality of electrodes 16 arranged parallel to one another. For clarity, only three electrodes 16*a*, 16*b* and 16*c* are shown. The electrodes 16 are arranged to lie at right angles to the electrodes 14 and the point at which one of the electrodes 14 overlaps one of the electrodes 16 defines a picture element or pixel of the array. The invention may be applied to liquid crystal devices having other arrangements of electrodes. The electrodes 14 are called the row electrodes and are driven by a controller (CNTL) 20 via a row driver (ROW) 18. The electrodes 16 are called the column electrodes and are driven by the controller via a column driver (COLUMN) 22.

In order to uniquely address the pixels in an array such as shown in FIG. 1, a scanning signal is applied in turn to each of one of the row electrodes. Data signals are then applied to the other plurality of column electrodes to co-operate with the scanning signals. Because the data signals are applied to all of the pixels in a particular column of the array, the relative amplitude and duration of the scanning signal and data signal must be arranged so that only the pixels in the row or rows to which the scanning signal is applied change state in accordance with the data signals.

Figure 2:
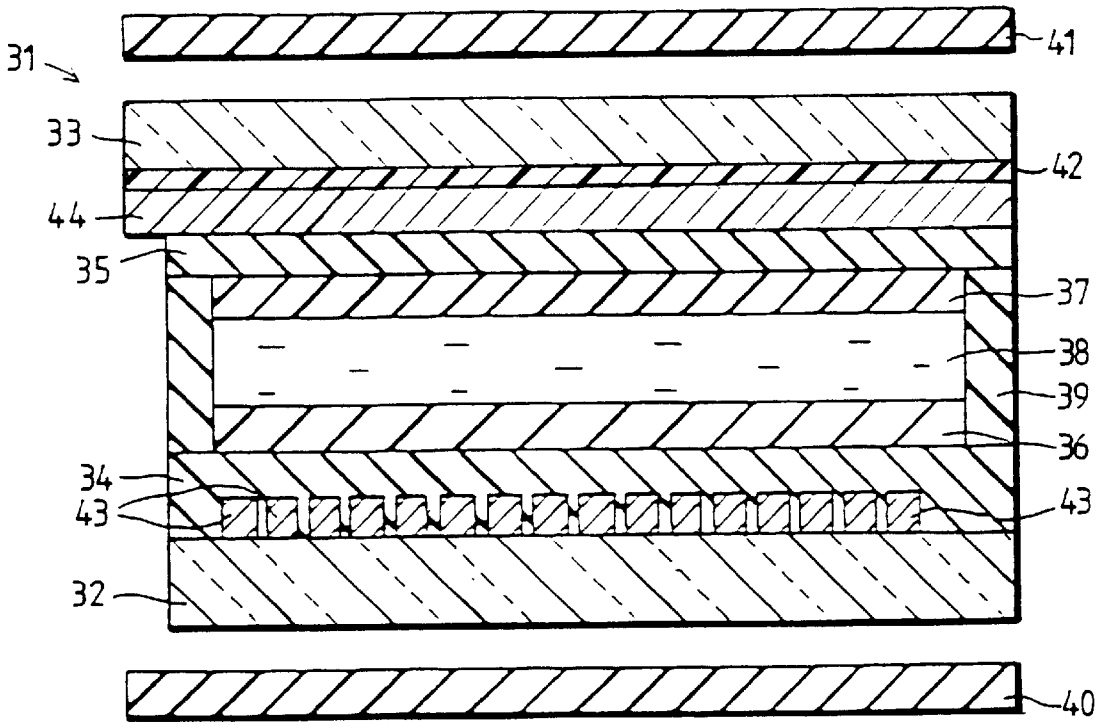
FIG. 2 shows a side elevational view of a ferroelectric liquid crystal device to which the present invention can be applied.
Figure 3A:
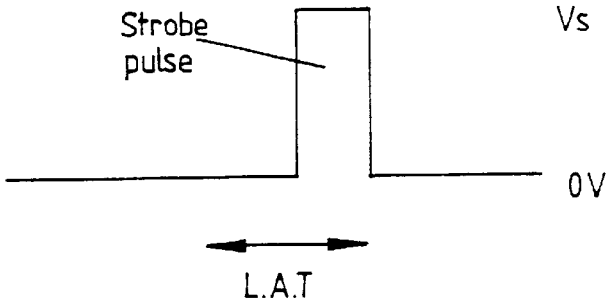
FIGS. 3(*a*) through 3(*d*) show row and column signals for application to a FLC array as used in the prior art.
Figure 3B:
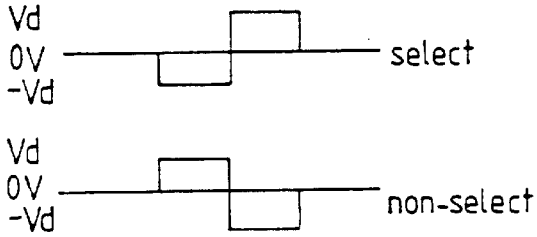
Figure 3C:
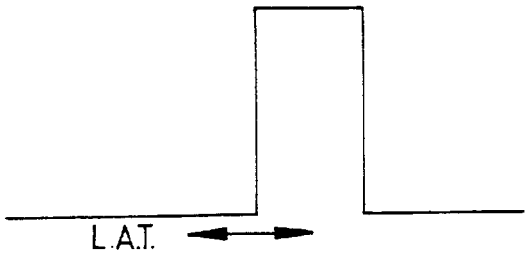
Figure 3D:
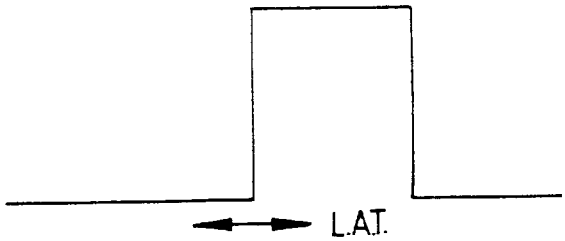

A ferroelectric liquid crystal display (FLCD) panel 31 to which the invention can be applied is shown diagrammatically in FIG. 2. The FLCD panel 31 comprises a layer 38 of ferroelectric smectic liquid crystal material contained between two parallel glass substrates 32 and 33 bearing first and second electrode structures on their inside surfaces, a colour filter layer 42 being interposed between the substrate 33 and the corresponding electrode substrate. The first and second electrode structures comprise respectively a series of row and column electrodes 43 and 44 of, for example, indium tin oxide electrodes which cross one another to form a matrix of modulating elements (pixels) at the intersections of the electrodes 43, 44. Each of the electrode structures is coated with a transparent insulating film 34 or 35 made of silicon oxide ($SiO_2$), for example. Furthermore alignment layers 36 and 37 made of polyvinyl alcohol, for example, are applied on top of the insulating films 34 and 35 so that the alignment layers 36 and 37 contact opposite sides of the ferroelectric liquid crystal layer 38 which is sealed at its edges by a sealing member 39. The panel 31 is disposed between polarizers 40 and 41 having polarizing axes which are substantially perpendicular to one another.

The invention is particularly applicable to a ferroelectric liquid crystal (FLC) panel, where the liquid crystal material has the following properties:

(i) a liquid crystal with a chiral smectic C phase at the operating temperature (ii) a material showing τVmin characteristics, hence having a spontaneous polarization less than 20 nC/cm$^2$ (iii) an FLC material with a cone angle between 10 and 45 degrees, preferably 22.5°

(iv) an FLC material with positive dielectric biaxiality.

Such a liquid crystal device is particularly suitable for addressing using a $\tau V_{min}$ addressing technique. FIGS. 3(*a*) through 3(*d*) illustrate part of the scanning and data signals applied as part of a known addressing technique.

A strobe portion (or pulse) of the scanning signal is shown at FIG. 3(*a*). This is applied to each of the first plurality (row) electrodes in turn. While the portion of the signal is applied to a particular row data signals are applied to the second plurality (column) electrodes to provide the desired state of the pixel where the row electrode overlaps the column electrodes. The upper data signal in FIG. 3(*b*) is a select signal, meaning that, when it is applied in conjunction with the strobe portion of the scanning signal, the relevant pixel will change state. The lower data signal in FIG. 3(*b*) is a non-select signal, meaning that, when it is applied in conjunction with the strobe portion of the scanning signal, the relevant pixel will not change state.

This addressing technique is called the JOERS/Alvey technique (or scheme). The JOERS/Alvey addressing technique is described in more detail in "The JOERS/Alvey Ferroelectric Multiplexing scheme" published in Ferroelectrics, 1991, Vol. 122, pages 63 to 79.

The present invention is applicable both to addressing schemes using a bipolar strobe portion of the scanning signal and to those using a blanking portion (or pulse) in the scanning signal. In the former case, each pixel is addressed twice: once to switch it dark (if required) and once to switch it white (if required). In the later case, a blanking portion of the scanning signal is applied to each row of the array a short time before the strobe portion of the signal is applied. This blanking portion places the pixels of a row in a known state (typically black) so that each pixel only needs to be addressed once to change its state if required.

Developments of this addressing technique exist in which the strobe portion of the scanning signal extends beyond one L.A.T. Strobe portions of the scanning signals (albeit at different time offsets) are then applied to two (or more) rows of the array simultaneously. The strobe portion of two such scanning signals are shown at FIGS. 3(*c*) and 3(*d*). FIG. 3(*c*) shows the so-called MALVERN3 strobe signal in which the strobe pulse extends into half of the following L.A.T. FIG. 3(*d*) shows a so-called MALVERN4 strobe signal in which the strobe pulse extends fully into the following L.A.T.

In operation, the data waveforms may vary from one row to the next. In the case of the same pixel state applied to a number of adjacent rows (e.g. black, black, black and so on) a waveform having a wavelength of the line address time (L.A.T.) will be applied to the column electrodes. In the case of different pixel states occurring on adjacent lines (e.g. black, white, black, white and so on) a waveform having a wavelength of twice the L.A.T. is applied to the column electrodes. These represent the extremes of wavelength that are applied to the column electrodes by the application of data signals.

Figure 4A:
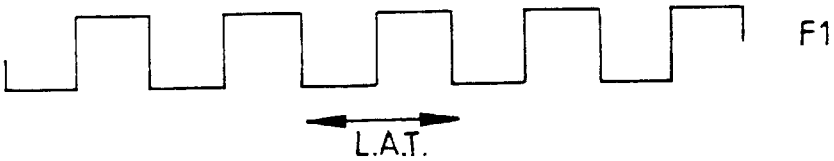
FIGS. 4(*a*) and 4(*b*) show a pair of waveforms having two extremes of data frequency which occur when using the prior art data signals.
Figure 4B:
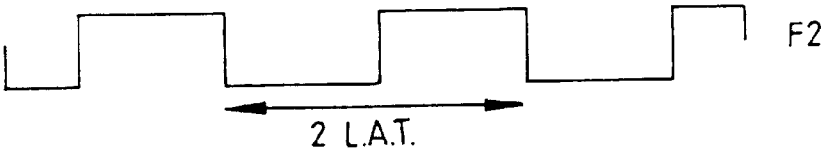

FIGS. 4(*a*) and 4(*b*) show these two waveforms, the signal F1 (corresponding to the same pixel state on a number of rows) has the wavelength of L.A.T. and the signal F2 (corresponding to alternate pixel states on adjacent rows) has the wavelength of 2 L.A.T. The signal F1 is the highest possible frequency applied to the liquid crystal device, and the signal F2 is the lowest possible frequency applied to the liquid crystal device. The data frequency effects the degree of AC stabilization of the ferroelectric liquid crystal (FLC) director, and thus contrast. This is particularly the case when the FLC alignment is in the C2U configuration, which is the usual alignment when utilizing τ-Vmin type FLC materials. Further details are available from "Fast, high-contrast ferroelectric liquid crystal displays and the role of dielectric biaxiality" by Jones, Towler and Hughes, published at pages 86 to 92 of Displays, Volume 14, Number 2, 1993.

The effect of the waveforms shown in FIGS. 4(*a*) and 4(*b*) will now be discussed.

Figure 5:
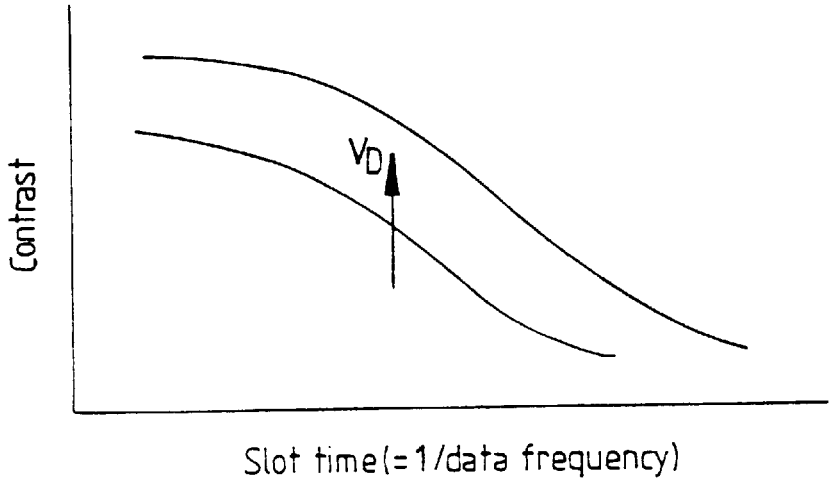
FIG. 5 shows a schematic diagram of contrast against data frequency for a ferroelectric liquid crystal device.

FIG. 5 shows a schematic graph of contrast against frequency of signals applied to the column electrodes. The upper curve corresponds with higher voltage data signals; higher values of $V_D$. It is clear from this graph that at lower data frequencies the contrast drops. Therefore a possible solution would be to make the data frequency very high. However, this has undesirable effects on the power consumption and the complexity of the addressing circuitry. The problem is addressed in one embodiment of the present invention by making the extremes of data frequency appear (to the pixel) as the same frequency by adding a low frequency signal to the row (scanning signal) electrodes.

Figure 6:
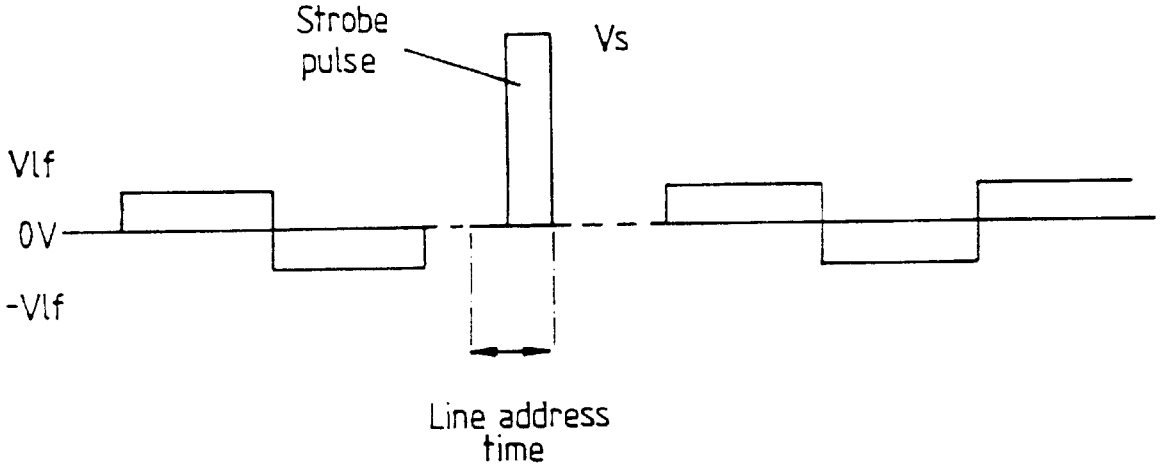
FIG. 6 shows a new row waveform according to an embodiment of the present invention.

FIG. 6 shows an example of scanning signals in accordance with the invention. Each scanning (row) waveform has a constant low frequency signal, at a low voltage Vlf, in addition to the normal strobe (and blanking, if appropriate) signal portions. The low frequency signal is an alternating signal having a frequency greater than the frame rate and less than or equal to the lowest possible data frequency F2. As a result the data voltage level Vd may be reduced with respect to known techniques to achieve good, substantially data-pattern-independent contrast performance with lower overall power consumption. The drive window (see reference identified above) is slightly reduced in this case. In this figure the frequency of the extra row waveform signal is 4 times lower than F1 of FIG. 4(*a*). The additional signal is not used in the immediate vicinity of the strobe portion of the scanning signal in order to maintain the normal prepulse (first half of L.A.T.) behaviour of the switching. The additional signal would typically cease to be applied a few L.A.T. (at least two line address times) before the strobe portion of the scanning signal. The additional signal would also typically not be re-applied until a few L.A.T. (at least two line address times) after the strobe portion of the scanning signal. This is to avoid upsetting the switching process. The invention is applicable to addressing schemes using a bipolar strobe and to addressing schemes using a blanking pulse (not shown).

By way of example, a monochrome SVGA panel having 600 rows may be addressed with a data frequency of 36 or 18 kHz (depending on data pattern), in which case the additional low frequency alternating signal may have a frequency of about 9 kHz. Alternatively, if temporal dither is utilized to increase the number of grey levels, for example to provide 16 grey levels using 4 temporal dither bits, this results in a data frequency of 144 or 72 kHz, in which case the additional low frequency alternating signal may have a frequency of about 36 kHz. In each case the low frequency alternating signal has a frequency lower than the data frequency and higher than the frame rate.

Figure 7:
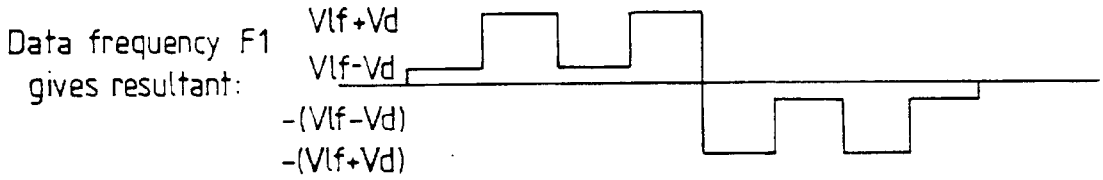
FIGS. 7(*a*) and 7(*b*) show examples of resultant waveforms caused by extremes of data frequency when using the waveforms of FIG. 6.
Figure 7:
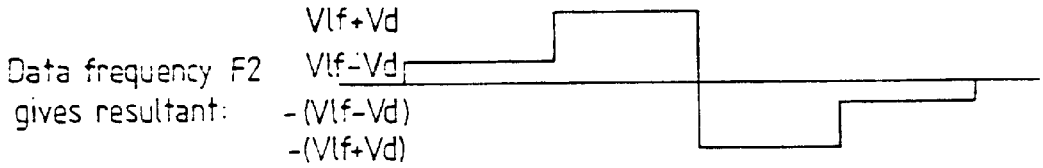

FIGS. 7(*a*) and 7(*b*) show examples of the resultant signals applied to pixels outside the select period (i.e. the part of the scanning signal used to address the pixel in conjunction with data signals) when the data pattern results in signals of F1 and F2. It is clear from this that the resultant basic frequency is the same in both cases, at one quarter of F1 in this example. The magnitude Vlf, of the low frequency signal must be low enough to avoid causing switching in its own right. In this example (FIG. 7) Vlf is greater than Vd though this is not necessarily the case.

Figure 8:
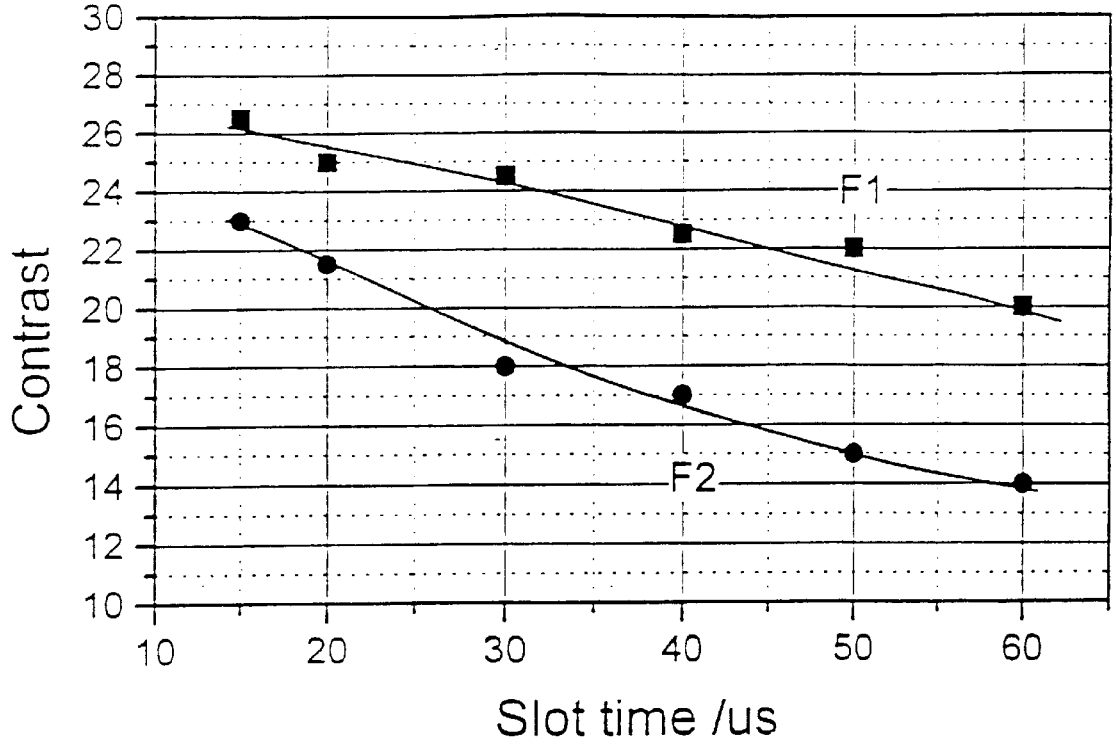
FIG. 8 shows a graph of contrast against slot time duration for standard row waveform, comparing two extremes of data frequency, Vd=5.6V, Vs=40V, SCE8 driven using MALVERN3 waveform.

FIG. 8 shows some experimental results of contrast against slot time using standard addressing for comparison. The material used was of the type discussed with reference to FIG. 2 such as SCE8 (available from Hoechst) though any FLC material with those suitable properties could be used. The material was aligned in a cell with parallel rubbed polyimide alignment layers having a surface tilt angle of less than 6 degrees and a cell thickness of between 1 and 2 μm. Measurements were made at 25 degrees centigrade.

In this case the magnitude Vs of the strobe portion of the scanning signal was 40V and the magnitude of the monopolar excursion of the data signal Vd was 5.6V. The cell was driven using the MALVERN3 addressing scheme, i.e. the strobe waveform was extended to 3 time slots. As before, the line address time is composed of two time slots, as this is the minimum required to produce the necessary data signal shapes. The two curves show the cases for the data forming a pattern giving resultant frequencies of F1 and F2. It is clear that with frequency F1 applied the contrast is greater than with F2. This is the maximum contrast variation with data pattern that could occur for a liquid crystal panel run under these conditions.

Figure 9:
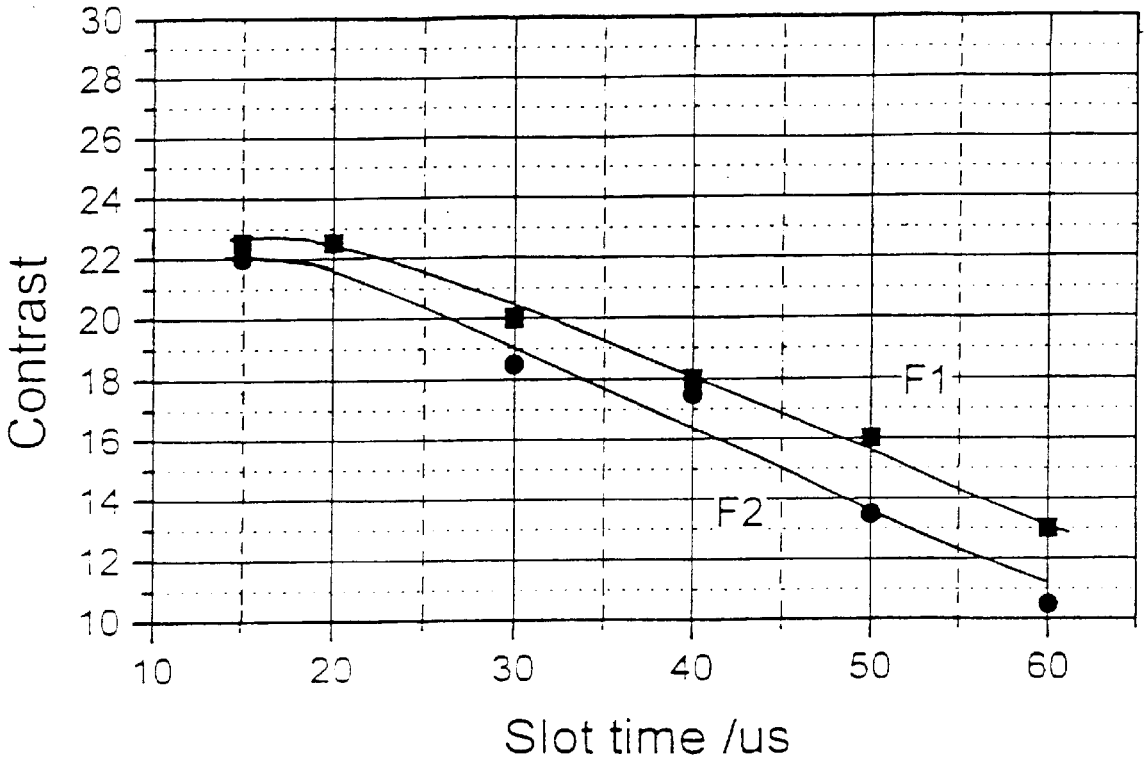
FIG. 9 shows a graph as shown in FIG. 8 but with a 4V low frequency signal on row signals and Vd=4V.

FIG. 9 shows a graph similar to FIG. 8 but utilizing scanning signals according to an embodiment of the present invention, with Vd=Vlf=4V. Again the two curves are for data patterns producing frequencies of F1 and F2, but in this case the addition of the low frequency signal to the scanning signal greatly reduces the contrast difference between the two lines. Hence contrast variation with data pattern has been significantly reduced.

Figure 10:
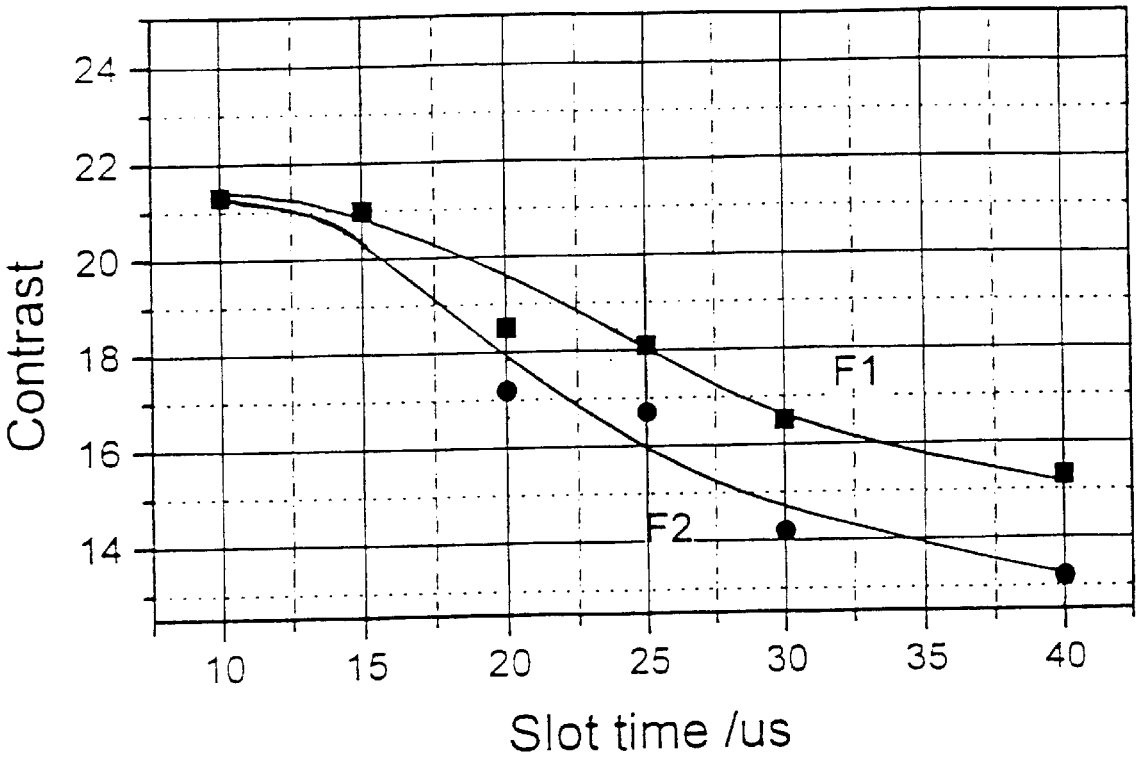
FIGS. 10 and 11 show graphs of the same comparison as in FIGS. 8 and 9 using MALVERN4 waveforms and RMS data voltage of 5.6V in both cases.
Figure 11:
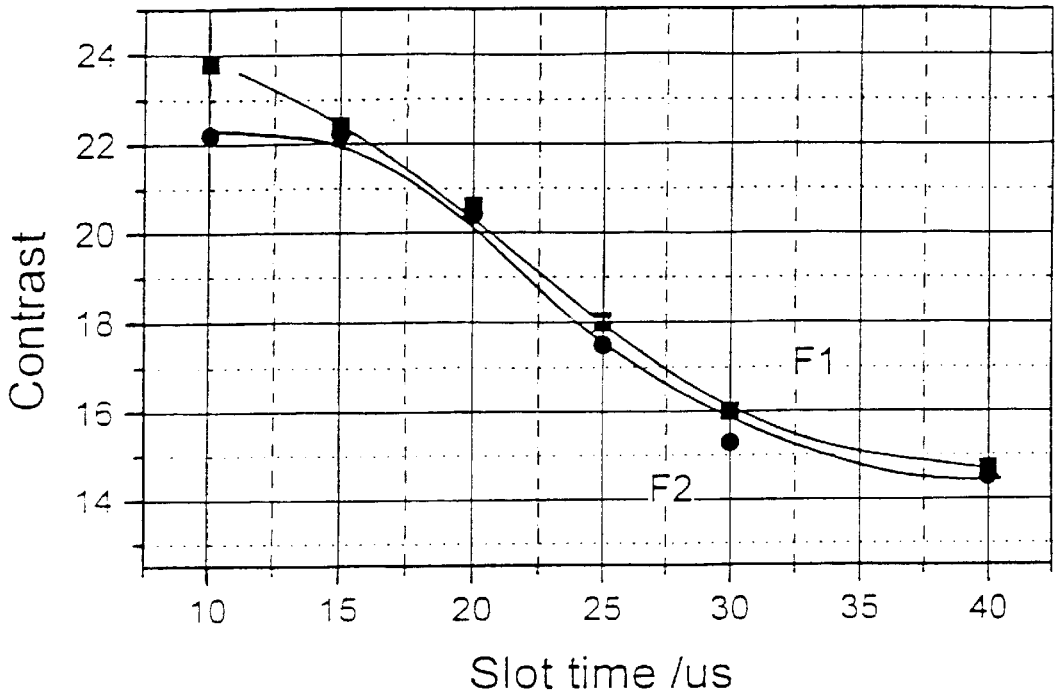

FIGS. 10 and 11 show another comparison between the standard JOERS/Alvey scheme and the current scheme using MALVERN4 extended strobe pulses and a data voltage Vd of 5.6V in the case of the standard scheme, and Vd=Vlf=4V (=5.6V RMS) in the case of the modified scheme. Again, a significant reduction in contrast variation in dependence on the data frequency is evident.

The power consumption in each of the examples can also be compared. Here we compare the power consumption resulting from the data signals alone (the prior art technique) with that of the present invention. The situation over eight consecutive time slots is considered and a representation of power dissipation derived from the square of the magnitude of the signal excursions.

The signal F1 shown in FIG. 4(*a*) results in a power dissipation as a consequence of eight excursions of a voltage (2×Vd). The value of Vd is 5.6V.

Figure 12:
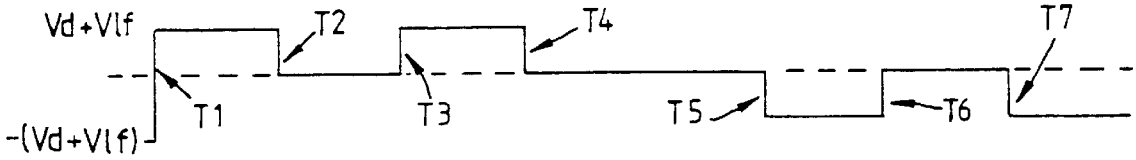
FIGS. 12(*a*) and 12(*b*) show examples of resultant signals in accordance with an embodiment of the invention.
Figure 12:
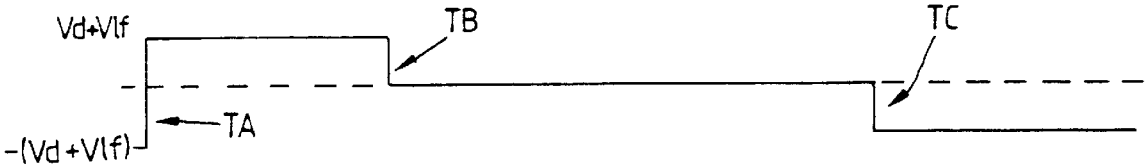

Power dissipation is thus proportional to $8\times(2\times Vd)^2=8\times 11.2^2=1003.5$ In comparison, a scanning signal with a low frequency component at one quarter of the frequency F1 is used with Vd=4V, Vlf=4V. These values of Vd and Vlf result in the same RMS signal applied to a pixel. The signal is shown in FIG. 12(*a*) and the power dissipation results from one excursion T1 of 2×(Vlf+Vd) and six excursions T2–T7 of (Vlf+Vd).

Power dissipation is proportional to $6\times(Vlf+Vd)^2+(2\times(Vlf+Vd))^2=640$ This represents a reduction of approximately 36% with respect to the prior art signals.

The signal F2 shown in FIG. 4(*b*) results in a power dissipation as a consequence of four excursions of a voltage (2×Vd). The value of Vd is 5.6V.

Power dissipation is thus proportional to $4\times(2\times Vd)^2=501.8$

In comparison, a scanning signal with a low frequency component at one half of the frequency F2 is used with Vd=4V, Vlf=4V as above. The signal is shown in FIG. 12(*b*) and the power dissipation results from one excursion TA of 2×(Vlf+Vd) and two excursions TB and TC of (Vlf+Vd).

Power dissipation is proportional to $2\times(Vlf+Vd)^2+(2\times(Vlf+Vd))^2=384$ This represents a reduction of approximately 23% with respect to the prior art signals.

Hence in general it is expected that such a scheme could achieve approx. 20 to 40% power reduction with respect to the prior art.

The examples given describe a frequency of the additional signal as one quarter of the highest possible frequency applied as a result of the data signals applied to the device (or one half of the lowest possible frequency). While this is a good compromise, the present invention is not limited to signals at such a frequency. Indeed, the frequency does not have to be related to those resulting from the data signals or synchronized to them.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of addressing a liquid crystal device having a first plurality of electrodes and a second plurality of electrodes defining a plurality of pixels at the intersections between at least one of the first plurality of electrodes and at least one of the second plurality of electrodes, the method comprising:

applying a scanning signal including at least one strobe portion to each of the first plurality of electrodes over a frame, and applying data signals to each of the second plurality of electrodes to cooperate with the at least one strobe portion of the scanning signal during a respective line address time to present selectively a switching voltage to each of the plurality of pixels represented by a voltage difference between the scanning signals and the data signals applied to the respective first and second plurality of electrodes, wherein the scanning signal further comprises an alternating signal outside of the line address time having a frequency greater than the frame rate and less than the lowest possible frequency applied to the device by the data signals.

2. A method of addressing a liquid crystal device as claimed in claim 1, wherein the alternating signal is not applied for at least two line address times prior to the application of the at least one strobe portion.

3. A method as claimed in claim 1, wherein the alternating signal is not applied for at least two line address times after the application of the at least one strobe portion.

4. A method as claimed in claim 1, wherein the alternating signal has a magnitude greater than that of the data signals.

5. A method as claimed in claim 1, wherein the frequency of the alternating signal is less than or equal to half of the lowest possible frequency applied to the liquid crystal device by the data signals.

6. A method as claimed in claim 1, wherein at least one excursion of the alternating signal is synchronized with the data signals.

7. A method as claimed in claim 1, wherein the frequency of the alternating signal has an integer relationship with the highest possible frequency applied to the liquid crystal device by the data signals.

8. A method as claimed in claim 1, wherein the liquid crystal is a ferroelectric liquid crystal.

9. A liquid crystal device having a first plurality of electrodes and a second plurality of electrodes defining a plurality of pixels at the intersections between at least one of the first plurality of electrodes and at least one of the second plurality of electrodes, further comprising:

means for applying one frame of a scanning signal including at least one strobe portion to each one of the first plurality of electrodes, and means for applying data signals to each of the second plurality of electrodes to cooperate with the at least one strobe portion of the scanning signal during a respective line address time to present selectively a switching voltage to each of the plurality of pixels represented by a voltage difference between the scanning signals and the data signals applied to the respective first and second plurality of electrodes, wherein the scanning signal further comprises an alternating signal outside of the line address time having a frequency greater than the frame rate and less than the lowest possible frequency applied to the device by the data signals.

10. A liquid crystal device as claimed in claim 9, wherein the alternating signal is not applied for at least two line address times prior to the application of the at least one strobe portion.

11. A liquid crystal device as claimed in claim 9, wherein the alternating signal is not applied for at least two line address times after the application of the at least one strobe portion.

12. A liquid crystal device as claimed in claim 9, wherein the alternating signal has a magnitude greater than that of the data signals.

13. A device as claimed in claim 9, wherein the frequency of the alternating signal is less than or equal to half of the lowest possible frequency applied to the liquid crystal device by the data signals.

14. A device as claimed in claim 9, wherein at least one excursion of the alternating signal is synchronized with the data signals.

15. A device as claimed in claim 9, wherein the frequency of the alternating signal has an integer relationship with the highest possible frequency applied to the liquid crystal device by the data signals.

16. A method as claimed in claim 9, wherein the liquid crystal is a ferroelectric liquid crystal.

17. An addressing arrangement for a liquid crystal device having a first plurality of electrodes and a second plurality of electrodes defining a plurality of pixels at the intersections between at least one of the first plurality of electrodes and at least one of the second plurality of electrodes, the arrangement comprising:

means for applying one frame of a scanning signal including at least one strobe portion to each one of the first plurality of electrodes, and means for applying data signals to each of the second plurality of electrodes to cooperate with the at least one strobe portion of the scanning signal during a respective line address time to present selectively a switching voltage to each of the plurality of pixels represented by a voltage difference between the scanning signals and the data signals applied to the respective first and second plurality of electrodes, wherein the scanning signal further comprises an alternating signal outside of the line address time having a frequency greater than the frame rate and less than the lowest possible frequency applied to the device by the data signals.

18. An arrangement as claimed in claim 17, wherein the alternating signal is not applied for at least two line address times prior to the application of the at least one strobe portion.

19. An arrangement as claimed in claim 17, wherein the alternating signal is not applied for at least two line address times after the application of the at least one strobe portion.

20. An arrangement as claimed in claim 17, wherein the alternating signal has a magnitude greater than that of the data signals.

21. An arrangement as claimed in claim 17, wherein the frequency of the alternating signal is less than or equal to half of the lowest possible frequency applied to the liquid crystal device by the data signals.

22. An arrangement as claimed in claim 17, wherein at least one excursion of the alternating signal is synchronized with the data signals.

23. An arrangement as claimed in claim 17, wherein the frequency of the alternating signal has an integer relationship with the highest possible frequency applied to the liquid crystal device by the data signals.

24. An arrangement as claimed in claim 17, wherein the liquid crystal is a ferroelectric liquid crystal.

* * * * *